United States Patent [19]

Putman

[11] Patent Number: 4,985,813

[45] Date of Patent: Jan. 15, 1991

[54] LIGHT FOR EMERGENCY USE

[76] Inventor: Gary W. Putman, P.O. Box 126, Greenleaf, Id. 83626

[21] Appl. No.: 166,543

[22] Filed: Mar. 10, 1988

[51] Int. Cl.[5] ..... F21L 1/00

[52] U.S. Cl. ..... 362/186; 362/184; 362/295; 362/802; 340/815.18; 340/321

[58] Field of Search ..... 362/157, 158, 200, 276, 362/802, 205, 293, 295, 811, 154; 340/321, 815.15, 815.18; 315/114, 116, 136, 124, 360; 200/60

[56] References Cited

U.S. PATENT DOCUMENTS

| | | | |
|---|---|---|---|
| 2,303,086 | 11/1942 | Muldoom | 200/60 |
| 2,894,257 | 7/1959 | Crooks | 362/80 |
| 3,274,382 | 9/1966 | Fattori | 362/205 |
| 3,323,117 | 5/1967 | Mason | 362/158 |
| 3,506,956 | 4/1970 | Kolm et al. | 340/425.5 |
| 3,588,490 | 6/1971 | Nicholl | 362/158 |
| 3,596,078 | 7/1971 | Owens | 362/184 |
| 3,748,457 | 7/1973 | Batizky et al. | 362/158 |
| 4,198,574 | 4/1980 | Price et al. | 315/360 |
| 4,349,748 | 9/1982 | Goldstein et al. | 315/360 |
| 4,355,309 | 10/1982 | Hughey et al. | 340/425.5 |
| 4,623,957 | 11/1986 | Moore et al. | 362/200 |
| 4,760,373 | 7/1988 | Reilly | 362/72 |

FOREIGN PATENT DOCUMENTS

| | | | |
|---|---|---|---|
| 254807 | 12/1928 | Italy | 315/360 |

*Primary Examiner*—Stephen F. Husar
*Assistant Examiner*—D. M. Cox
*Attorney, Agent, or Firm*—Frank J. Dykas; Craig M. Korfanta

[57] ABSTRACT

An internally illuminated sphere 10 which will provide portable high intensity light suitable for emergency use, police use, traffic control or other purposes. It consists of a light source 21, a power source 27, and a control which may be internal or external and will provide continuous, intermittent or delayed operation.

5 Claims, 3 Drawing Sheets

LIGHT FOR EMERGENCY USE

BACKGROUND OF THE INVENTION

1. Technical Field

The present invention relates to spheres which are illuminated by means of an internal power source and more particularly to a new and improved illuminated sphere which will provide portable high intensity light suitable for emergency use, police use, traffic control and other purposes.

2. Background Art

There are numerous balls or spheres that are illuminated internally and are described generally as toys or play balls for night time use. United Kingdom Patent No. 529,271 describes a generally egg shaped device with a light inside and a flat bottom that would make the device stand upright. U.S. Pat. Nos. 2,942,379; 1,425,945 and 2,948,819 describe game balls with internal power sources to illuminate them wherein the location of the power source causes the sphere to assume an upright position. U.S. Pat. No. 3,323,798 describes a structure with a flattened bottom and weights located to make the device remain upright. The other aforementioned patents are representative of the prior art.

These devices are toys designed for the amusement of both adults and children. What is needed is a spherical light for emergency use which enables a law enforcement officer to project light to a remote location at some distance from the law enforcement officer. Such illumination is impossible with current hand carried lanterns. Additionally, hand carried lanterns have a disadvantage in that they clearly mark the location of the holder of the lantern.

Thus, in the situation of a law enforcement officer examining the interior of a darkened warehouse, the law enforcement officer currently has two choices, first to turn on the overhead lights, thereby illuminating the large section of the warehouse and making the law enforcement officers exact location immediately known, or, to use a flashlight which, for all practical purposes will do the same thing. What is needed is a means of rolling or throwing an emergency light down the warehouse aisle to a remote location.

Another object of this invention is to provide a time delay to delay the time at which the illumination commences, in order to give the law enforcement officer time to properly position the spherical light and then move to another location. A second embodiment would be to provide radio control means for remotely activating said spherical lights after they have been placed in position.

The prior art does not teach any spherical illumination means which utilizes non-visible portions of the light spectrum such as infrared light. Again, in the case of law enforcement officers, spherical lights which transmit infrared light can be remotely positioned and activated to provide illumination for law enforcement officers wearing apparatus adapted for converting infrared light to visible light images.

Accordingly, it is an object of this invention to provide a spherical light for emergency use which is adapted to be rolled or thrown to a location remote from the original user. A second object is to provide time delay control means for delaying the time for commencement of illumination for a sufficient period to enable the user to roll or throw the emergency light to its desired location.

A third object is to provide remote control means for initiating illumination in order to provide for effective prepositioning of the emergency lights prior to operation.

Another object of the invention is to provide an emergency light which utilizes non-visible portions of the light spectrum, which when properly adapted for, will enable the user to view the illuminated area, while at the same time effectively preventing another person in the illuminated area from detecting the presence of light.

Other objects of this invention are to provide a portable illuminated sphere system which will be of durable and rugged construction under repeated and extended use conditions; to provide a portable illuminated sphere system which may be of low cost of manufacture with regard to both materials and labor and thus may be sold at lot and reasonable prices; to provide a portable illuminated sphere system multiple units of which may be carried aboard automobiles, airplanes, emergency vehicles, boats and other carriers and stored easily and conveniently therein; to provide a portable illuminated sphere system which will provide portable, high intensity light of a continuous or intermittent nature suitable for emergency use, police use, aircraft use, marine use, traffic control or other purposes.

DISCLOSURE OF INVENTION

To attain these objects the present invention envisions a portable, hollow, sphere constructed partially or entirely of light transmitting material and enclosing a power source and a light source. The sphere is separable into two or more parts to permit access to the interior power source and light source. The power source and light source are operably interconnected and mechanically secured in an understood manner within the hollow sphere. The sphere is constructed of high impact resistant material which will transmit light and the entire portable illuminated sphere system is designed and constructed to operate for extended periods within environmental extremes. The power source and light source are designed and constructed to provide high intensity continuous or intermittent visible or other radiation.

A variety of control means are provided, depending upon the desired features. The first, and simplest is simple on/off control means operable manually by the user. The second is a time delay feature which provides for a five, ten or other seconds of delayed time before operation. And a third is a radio controlled operation wherein the light means are illuminated by means of remote control circuitry.

BEST MODE FOR CARRYING OUT INVENTION

Figure 2:
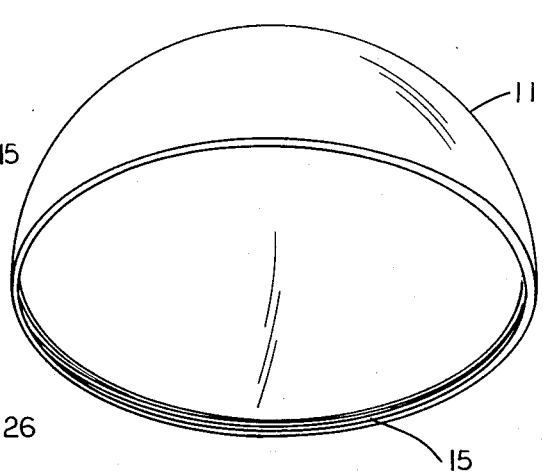
FIG. 2 is a perspective view of the upper cover.
Figure 1:
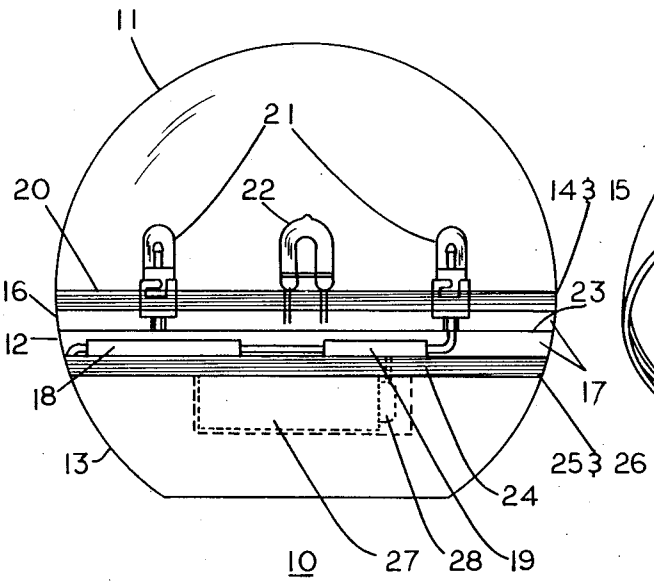
FIG. 1 is a side sectional, representational view of the light sphere.
Figure 4:
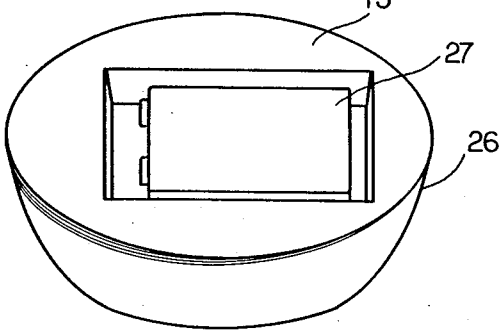
FIG. 4 is a perspective view of the base.
Figure 3:
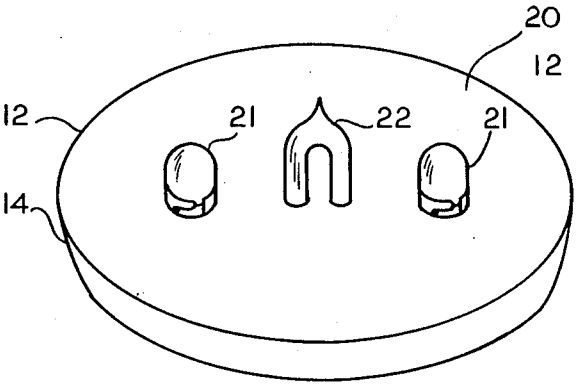
FIG. 3 is a perspective view of the middle segment.
Figure 5:
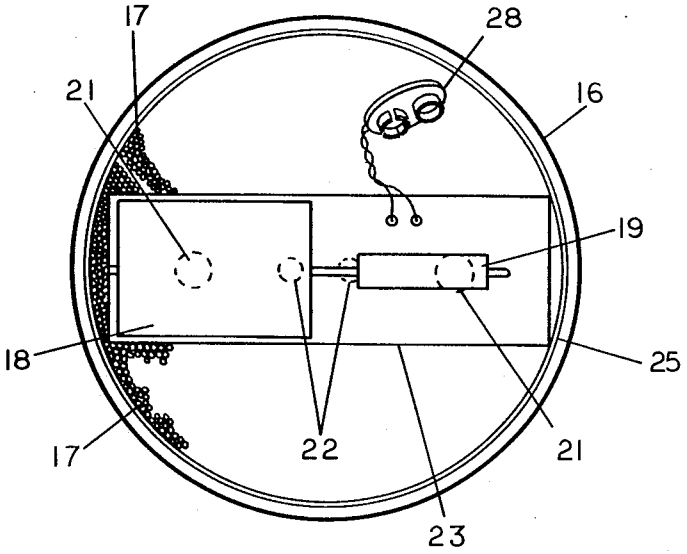
FIG. 5 is a bottom sectional representational view of the middle segment.

Referring to FIGS. 1 through 5 of the drawings, an improved portable illuminated sphere 10 is constructed using a three (3) part spherical container, an upper spherical zone constitutes the cover 11, the middle spherical zone constituting the middle segment 12, and the lower spherical zone constituting the base 13. Cover 11 is made so it will transilluminate detectable wave lengths of electromagnetic radiation such as the visible and infrared wavelengths. Cover 11 is also highly impact resistance. Upon cover 11 and middle segment 12 are threaded together by a set of right handed male threads 14 around the outside of the top edge of the middle segment 12 and right handed female threads 15 located on the inside edge of the upper cover 11. However, the means for connecting is in no way limited to the threaded connection.

The middle segment 12 has a metal outer wall 16 in which all the electronics of the device are supported and encased in a high density foam 17. Said metal outer wall 16 also acts as an antenna for the remote control means which includes a receiver 18 and servo-relay 19. An alternative control means for activating the portable illuminated sphere is a manual or electrical switch, which may include time delay circuitry, to allow the operator sufficient time to leave the environment before actuation of said illumination.

Middle segment 12 has joined to it a highly reflective circular top surface 20. Said circular top surface 20 and middle segment 12 are joined at the inside of the right handed male threads 14. Top surface 20 is generally flat, however a slightly concave or convex surface may be used to focus or diverge the illumination. The top surface 20 supports the illumination mounting hardware. The illumination source consists of two halogen type high intensity incandescent bulbs 21 and one xeon flash strobe 22, however, many configurations of illuminating sources are possible. The supporting electronics are located on a circuit board 23 directly below said top surface 20. High density foam 17 separates the circuit board 23 and the top surface 20. Said high density foam 17 is used as a shock absorbing mechanism. Middle segment 12 has a circular base plate 24 located directly below the circuit board 23. There is another layer of high density foam 17 between said circular base plate 24 and circuit board 23.

Middle segment 12 is connected to base 13 by left handed threads 25 and 26. The circular base plate 24 of middle segment 12 has a protruding ridge around the circumference of circular base plate 24 which houses a set of left handed female threads 25. The combination of right handed threads 14 and 15 for upper cover 11, and left handed threads 25 and 26 for base 13 facilitate easy assembly.

Base 13 is constructed from a highly impact resistent material. Said base 13 is connectable to middle segment 12 by a left handed set of male threads 26, having the same orientation as the female threads 25, which are located around the outside edge of said base 13. Base 13 has a flat bottom which provides a means for biasing the portable illuminated sphere 10 in a general upright position. Base 13 also acts as a housing for securing harboring the power supply 27. Power supply 27 is a standard rechargeable battery. An electrical connection 28 is provided to connect said power supply 27 to said circuit board 23.

A typical use of the portable illuminated sphere 10 fitted with a remote control actuation means might be a situation where law enforcement personnel are responding to a burglar alarm in a dark environment such as a warehouse. The law enforcement personnel could enter the warehouse and place a plurality of portable illuminated spheres 10 in various areas of the warehouse by either placing or rolling portable illuminated spheres in or to desired locations. Once the portable illuminated spheres 10 are positioned, the law enforcement personnel then actuate the portable illuminating spheres 10 by remote control means. A portable illuminated sphere 10, fitted with a time delay actuation means, could be used in a similar manner. Using an infrared illumination source and a detector means, the law enforcement personnel would be able to detect an intruder while the intruder is unaware he is visible to the law enforcement personnel.

Portable illuminated spheres 10 may be used in place of the typical emergency flares. The advantage being not only do the portable illuminated spheres 10 provide a visual caution signal, but they also provide a greater amount of illumination to the immediate area than do standard emergency flares. A non-typical example of this might be wherein emergency personnel use portable illuminated spheres 10 to mark the perimeter of an emergency helicopter landing pad. The immediate area surrounding the emergency landing pad would be much more visible to the helicopter pilot than if standard emergency flares were used.

The foregoing is considered as illustrative only of the principles of the invention. Since numerous modifications and changes will readily occur to those skilled in the art, it is not desired to limit the invention to the exact construction and operation shown and described, and accordingly, all suitable modifications and equivalents may be restored to, falling within the scope of the invention.

Accordingly, what I claim is:

1. A portable illuminated sphere means for illuminating environment comprising:

spherical container means, fabricated of high impact resistant material, for enclosing illumination means, said spherical container means including transillumination means;

illumination means disposed within said container means;

means for biasing said sphere for positioning said transillumination means;

an electrically operable switch for switching said illumination means on and off;

radio control means for remotely controlling the operation of said electrically operable switch, said radio control means further having means for controlling intermittent activation of said illumination means.

2. The apparatus of claim No. 1 wherein said illumination means is an electrically powered halogen light.

3. The apparatus of claim No. 1 wherein said illumination means is an electrically powered incandescent light.

4. A portable illuminated sphere means for illuminating environment comprising:

spherical container means, fabricated of high impact resistant material, for enclosing illumination means, said spherical container means including transillumination means;

illumination means for transmission of detectable non-visible wave lengths of radiation, being disposed within said container means;

means for biasing said sphere for positioning said transillumination means;

an electrically operable switch for switching said illumination means on and off;

radio control means for remotely controlling the operation of said electrically operable switch, said radio control means further having means for controlling intermittent activation of said illumination means.

5. The apparatus of claim No. 4 wherein said detectable non-visible wave lengths of radiation are contained within the infrared radiation band width.

* * * * *